United States Patent [19]

Scales et al.

[11] Patent Number: 4,592,675

[45] **Date of Patent: * Jun. 3, 1986**

[54] REVETMENT PANEL WITH STAGGERED COMPARTMENTS

[75] Inventors: John M. Scales, Norcross; Bernard F. Wolcott, Roswell, both of Ga.

[73] Assignee: Nicolon Corporation, Norcross, Ga.

[ * ] Notice: The portion of the term of this patent subsequent to May 22, 2001 has been disclaimed.

[21] Appl. No.: 589,485

[22] Filed: Mar. 14, 1984

Related U.S. Application Data

[63] Continuation-in-part of Ser. No. 424,563, Sep. 27, 1982, Pat. No. 4,449,847.

[51] Int. Cl.[4] ..... E02B 3/12

[52] U.S. Cl. ..... 405/19; 405/18; 139/387 R

[58] Field of Search ..... 405/18, 19, 15, 16; 139/384 R, 387 R, 388

[56] References Cited

U.S. PATENT DOCUMENTS

| | | | |
|---|---|---|---|
| Re. 27,460 | 8/1972 | Lamberton . | |
| 3,396,542 | 8/1968 | Lamberton | 405/18 |
| 3,396,545 | 8/1968 | Lamberton | 405/233 |
| 3,397,260 | 8/1968 | Lamberton | 264/86 |
| 3,474,626 | 10/1969 | Colle | 405/18 |
| 3,561,219 | 2/1971 | Nishizawa et al. | 405/19 |
| 3,696,623 | 10/1972 | Heine et al. | 405/18 |
| 3,699,686 | 10/1972 | DeWinter | 405/18 |
| 3,786,640 | 1/1974 | Turzillo | 405/18 |
| 3,837,169 | 9/1974 | Lamberton | 405/18 |
| 3,957,098 | 5/1976 | Hepworth et al. | 150/9 |
| 4,102,137 | 7/1978 | Porraz et al. | 405/18 |
| 4,135,843 | 1/1979 | Umemoto et al. | 405/18 |
| 4,154,061 | 5/1979 | Umemoto et al. | 405/19 |
| 4,184,788 | 1/1980 | Colle | 405/19 |
| 4,449,847 | 5/1984 | Scales et al. | 405/19 |
| 4,502,815 | 3/1985 | Scales et al. | 405/18 X |

FOREIGN PATENT DOCUMENTS

| | | |
|---|---|---|
| 636074 | 7/1971 | Japan . |
| 706813 | 4/1973 | Japan . |

OTHER PUBLICATIONS

Fabriform ® brochure in Japanese.
Brochure entitled "Fabriform Concrete Bags ®".
Brochure entitled "Fabricast ® Molded Gravity Blocks".
Brochure entitled "Fabriform ® Concrete Forming System".
Brochure entitled "Fabricast ® Molded Blocks".
Brochure entitled "Fabriform ® is the solution to erosion problems".
Brochure entitled "Fabriform ® RAY vetmat TM ".
Brochure entitled "FABRIFORM".
Waterways, Port, Coastal and Ocean Division of American Society of Civil Engineers, *Coastal Structures* 79 (vols. I & II 1979).
Brochure entitled FABRIC FORMS FOR CONCRETE.

*Primary Examiner*—Dennis L. Taylor
*Attorney, Agent, or Firm*—Kilpatrick & Cody

[57] ABSTRACT

A revetment panel for installation along embankments and other earthen structures, including structures partially or fully covered by water, which utilizes a fabric web having a plurality of compartments. The compartments are staggered in relation to each other and separated by selvage. The web is formed of two fabric layers, which are woven separately to form the compartments and fastened together to form selvage separating them. Slots are formed in the selvage which allow cables to pass longitudinally through the web and interlock the compartments, and which allow filler material to flow between compartments during filling. The web is transported to its installation site and placed. The compartments in the web are then inflated with the filler material, which may be cementitous slurry or mortar consisting in part of sand and gravel found near the installation site, or simply a mixture of sand, gravel, and water or other ingredients. The resulting matrix of forms interconnected by fabric and cable provides a durable, economical and flexible erosion control layer. Later, the fabric may wear away leaving a highly articulable mat of hardened forms interconnected and interlocked by longitudinal cables or other connecting means.

19 Claims, 10 Drawing Figures

REVETMENT PANEL WITH STAGGERED COMPARTMENTS

BACKGROUND OF THE INVENTION

This application is a continuation-in-part of our earlier application for a U.S. Patent entitled REVETMENT PANEL, filed on Sept. 27, 1982 and having Ser. No. 424,563, now U.S. Pat. No. 4,449,847.

This invention relates to a revetment panel comprising a matrix of forms which are staggered in relation to one another and are interconnected by cables and fabric, and a method of constructing in situ the revetment panel. The invention is used for erosion control or other purposes and is typically placed on embankments and other earthen structures below, at or above the water line.

It has long been known to place erosion control structures along river and channel banks, shore lines and coast lines, and other places subject to erosion from hydraulic forces. Such structures have taken the form of, among other things, rip-rap, unconnected concrete blocks or slabs and prefabricated blocks or other forms which must be transported to the installation site and there interconnected by cables or interlocking means and placed into position.

Also known is the technique of constructing erosion control structures in situ by filling the void between two laid-in-place interconnected fabric layers with a flowable filler material of sand or cementitious slurry. The filler material, which may be pumped into the void between such fabric layers either above or below the water line, may later harden into a monolithic structure.

Several techniques have been previously used to control separation of fabric layers in previous in situ formed structures as filler material is pumped between the layers, and therefore to control the thickness of the hardened, monolithic structures. The two fabric layers have been fastened in contact with each other at a plurality of spaced points, for instance. Fabric layers have also been interconnected by drop stitching them together at a predetermined distance. Straps and ties extending across the outer surfaces of the fabric layers have also been used. According to another technique, the width of the monolithic structure is controlled by a system or network of cords interconnecting or linking the fabric layers. Furthermore, wires woven into the fabric layers have been used; wires of one fabric layer are linked to wires of the other fabric layer, typically by the use of a third set of wires.

It is further known to construct in situ an erosion control structure formed of a plurality of pockets between two fabric layers, by filling the pockets with sand or cementitious filler material. The fabric layers later serve to bind together the hardened pockets. Such a network of hardened forms, unlike the monolithic hardened structures mentioned above, is able to adapt to the changing contour of the earthen surface being protected, which may slowly erode or accrete from the hydraulic forces under the structure, or which may expand or contract due to ice formation. A further advantage of such a network or matrix is that hydraulic pressure above and below the structure is more readily equalized because of the numerous spaces between the hardened forms, resulting in less stress on the hardened material than in monolithic structures. Since the integrity of such a network or matrix structure depends on the integrity of the fabric interconnecting the hardened forms, which fabric is subject to deterioration and abrasion, such a structure tends to be impermanent.

SUMMARY OF THE INVENTION

The revetment panel of the present invention has the advantageous features discussed above, but achieves these features at a lower cost and more efficiently than earlier systems by using a fabric web having a plurality of compartments which are staggered in relation to one another and which are separated and interconnected not only by selvage fabric, but also by cables or other connecting means which pass through the compartments in a single direction.

During manufacture of the web, slots are formed in the selvage to provide limited communication between the compartments for filling purposes and so that cables or other connecting means may later be passed through these slots and from one compartment to the next. The web is then laced with cables or other connecting means. Washers and cable stops may be placed on the cables adjacent to the edges of the web to prevent leakage of filler material from the compartments in the web, and to hold the cables in place in the web. The web is then folded or rolled, packaged if necessary, transported to the site and placed. It may be placed on a prepared or unprepared surface and, if desired, on a filter system. The filter system may be woven or non-woven filter fabric, or a filter comprising layers of stones and sand, or other material. After the web is placed on the site, the compartments are filled with filler material which may harden and leave a matrix of hardened forms interconnected by the cables as well as by the selvage of the web. Portions of the cables may be held in place during filling, if it is desired that the cables be fixed in the center of the forms. Alternatively, if the cables are not held, they buckle to some extent during filling as the forms inflate, and thus are locked within the hardened forms. Later, the web may wear away from abrasion or decomposition, but the matrix of hardened forms remains interconnected by cables or other connecting means and a revetment panel remains intact which is more articulable than previous mats of hardened forms utilizing fabric layers.

The web of the preferred embodiment of the present invention is produced on a single loom capable of weaving two fabric layers simultaneously, such as has been used for various purposes. The loom may thus weave the layers separately to form walls of compartments and various slots, and interweave the layers to form the selvage intercon-necting them. In this fashion, a strong web having compartments between two fabric layers to receive filler material is formed with less time, effort and expense than that incurred in producing two fabric layers and subsequently fastening them together. Nevertheless, where circumstances require, the selvage of the web of the present invention may be formed by such alternative fastening methods as stitching, heat bonding or stapling, for example.

The web is placed on its prepared site by anchoring the top edge and unrolling the remainder down slope, by weighting and dropping the bottommost portion into the water (if it must be submerged), or by any other convenient method. The end of a filler hose connected to a pump and a filler material supply is then passed into a compartment which is typically several compartments up from the bottommost compartment in a column of compartments. The filler hose may be connected to the compartment by means of an opening in one of the fabric layers comprising the wall of the compartment. The opening may be in the form of a rigid or fabric valve, or it may simply be a hole cut in the fabric layer. The compartments in the web below this compartment are then filled, the filler material flowing through filling slots in the selvage. Locally found sand and gravel may be used to prepare the filler material for the web. Because it does not require shipment of sand and gravel material, the present invention results in lower transportation costs than systems in which prefabricated blocks are transported to the site and subsequently connected by cables or other means and installed.

During the process of filling the web of the present invention, the expansion of each compartment causes the selvage along its edge to draw toward the center of that compartment. If cable is used as interconnecting means, and not restrained, this "drawing up" process tends to buckle, to some extent, the cable within that compartment. The cable may thus securely implanted in each form.

Because the filling slots in the compartment of the present invention are arranged so that the filler material may flow only longitudinally from one compartment to the next and not laterally, the web of the present invention is filled a column at a time. Because the length and width of each compartment decreases while its height increases as it is being filled, this feature of the web and panel of the present invention allows one to place one column of compartments of the web as an anchor in final position. That column acts as an anchor when filled, and the installer may thus accurately predict the post-filling position of the panel.

Special slots are provided in the web and panel of the present invention through which cables pass to interconnect the compartments. When the filler material pumped into the panel hardens, these cable slots contain an insignificant amount of hardened filler material. The filler material so contained fails easily and the cable slots therefore do not significantly prevent the panel from flexing. Only two of the slots communicating with each compartment carry any significant amount of filler material, but these two slots act as controlled failure points similar to the cable slots when the filler material hardens. The panel of the present invention thus provides a flexible revetment structure.

Revetment panels of the present invention may be connected to each other by sewing or bonding the side edges together to provide a continuous layer of flexible, durable, relatively inexpensive erosion protection. The side edges of the webs and panels of the present invention may be located at the approximate centers of filling slots, and neighboring panels may thus be aligned with each other and fitted together without the need for also connecting selvages. Because of this feature, a continuous layer may be formed of connected revetment panels, with no openings through which water or the elements may directly pass.

Accordingly, it is an object of the present invention to provide a revetment panel including a web which may be woven on a single loom to form compartments and selvage.

It is a further object of the present invention to provide a revetment panel in which the selvage between compartments has slots through which cables or other connecting means may pass, and additional slots through which filler material may flow between compartments during the filling process.

It is another object of the present invention to provide a revetment panel which may be constructed in situ, which comprises a network or matrix of hardened forms interconnected by fabric and cable or other connecting means, and which may be joined with other panels to provide a continous layer of erosion protection with no openings through which water or other elements may directly pass.

It is still another object of the present invention to provide a revetment panel which may be constructed in situ, which originally comprises a network or matrix of hardened forms interconnected by fabric and cable or other connecting means, and which after the fabric decomposes or is abraded, remains interconnected by cable or other connecting means, and is highly articulable.

It is yet a further object of the present invention to provide a revetment panel which may be constructed in situ with locally found sand or gravel, thereby achieving savings in effort and expense in its transportation to the installation site, but which has the beneficial characteristics of flexibility, adaptability, and durability found in revetment structures comprising a network or matrix of hardened forms interconnected by cable or other connecting means.

It is still a further object of the present invention to provide a revetment panel which is simple, inexpensive and easy to produce, place and install in a minimum amount of time.

It is yet another object of the present invention to provide a revetment panel which may be constructed in situ underwater, with a minimum need for divers or underwater operations.

Other objects and advantages of the present invention will become apparent during the course of the following summary and description.

DETAILED DESCRIPTION OF THE DRAWINGS

Figure 1:
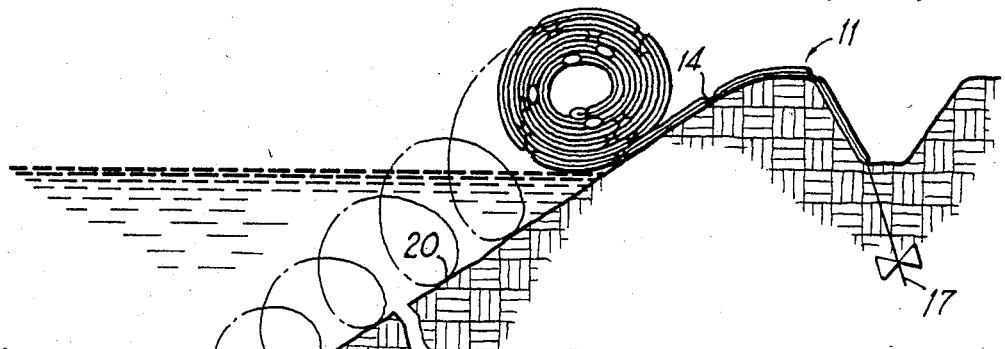
FIG. 1 is a side elevational view of one embodiment of the web of the present invention, showing installation by rolling the anchored web downhill.

FIGS. 1–4 are side elevational views illustrating installation of the present invention. In FIG. 1, a web 11 of the present invention is shown during placement on its prepared site. The site may be any surface 20 prone to erosion, including banks and shorelines along rivers and 10 channels, bridge embankments, and cuts and fills along the road and railroad rights of way. The site may be prepared, if desired, by cutting toe and/or anchor trenches and grading. However, the present invention is equally effective and easily placed where site preparation is not or cannot to be undertaken, such as along the icy and rocky coastlines found in arctic climates.

Placement of web 11 on a submerged or partially submerged site such as that depicted in FIGS. 1–4 may be facilitated by weights 15 attached along its bottom and side edges. Weights 15 may be press-on type lead weights, or they may take the form of a chain attached along the bottom and/or side edges of web 11. Web 11 may be deployed by being rolled downhill from its anchored edge, as depicted in FIG. 1; its bottommost end may be towed and released over the installation site, or any other suitable method of deployment may be used. The first method is particularly suited for shallow water installations, and since no barge or boat is required, it is convenient. Towing is particularly appropriate in deep water installations, or where web 11 has been folded and stacked rather than rolled during packaging at the manufacturing site. Accurate placement may be ensured by a remotely actuated release bar which may be attached to the bottom-most edge of web 11 and to a towing barge or boat by an activation line.

The top edge of web 11 may be anchored during the filling process by attaching cables 16 protruding from web 11 to anchors 17; similarly, one or more of the uppermost compartments may be placed in a top trench and filled, or simply filled to act as an anchor. Anchors 17 may take the form of helix earth anchors, deadmen, buried pipe or other suitable means.

Figure 3:
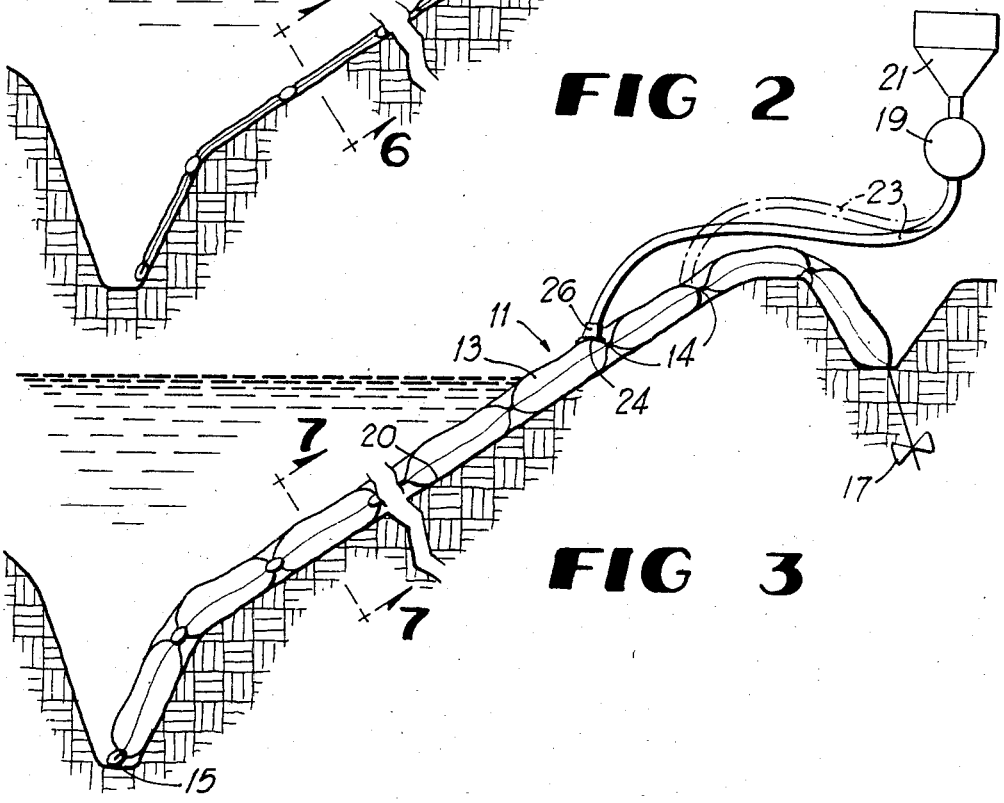
FIG. 3 is a side elevational view of the web of FIG. 1 showing filling of certain of the compartments of the web.
Figure 4:
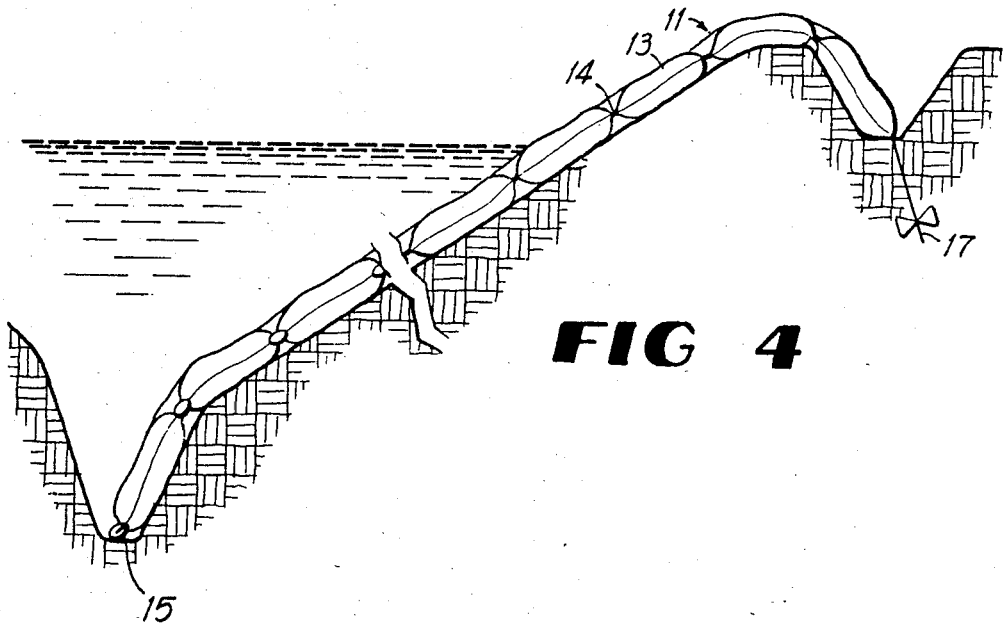
FIG. 4 is a side elevational view of one embodiment of the filled web, or revetment panel, of the present invention.

With reference to FIG. 3, compartments 13 of web 11 are filled with the aid of pump 19, a filler material supply 21 and a filler hose 23. Web 11 is typically filled by filling a column of compartments 13 at a time. Filling is typically accomplished by forming an opening 24 in a selected compartment 13 which is usually several compartments from the bottommost compartment in the column. Filler hose 23 is then inserted and filler material 28 pumped through this opening 24. Filler material 28 flows through filling slots 27 and fills all compartments 13 below the compartment 13 in which opening 24 is cut. Filling slots 27 communicate between compartments 13 in the longitudinal direction in web 11, and thereby interconnect columns of compartments 13. "Longitudinal" means parallel or substantially parallel to the axes of filling slots 27. "Lateral" means normal, or substantially normal, to longitudinal. Filler material 28 is pumped to a predetermined pressure, which may be great enough to eject or expel a portion of the water from filler material 28, thereby allowing quicker hardening. Filler hose 23 is then withdrawn from opening 24, which may then be sealed, and the process is repeated to accomplish filling of web 11. Where compartments 13 are situated in an anchor trench and thus situated on a gradient opposite in direction to the surface 20 being protected, they may be similarly filled, before, during, or after filling of the remainder of web 11. If such compartments 13 are filled before the remainder of web 11, they tend to anchor that remainder as it is filled, and thus to prevent slippage of web 11 during filling.

Figure 9:
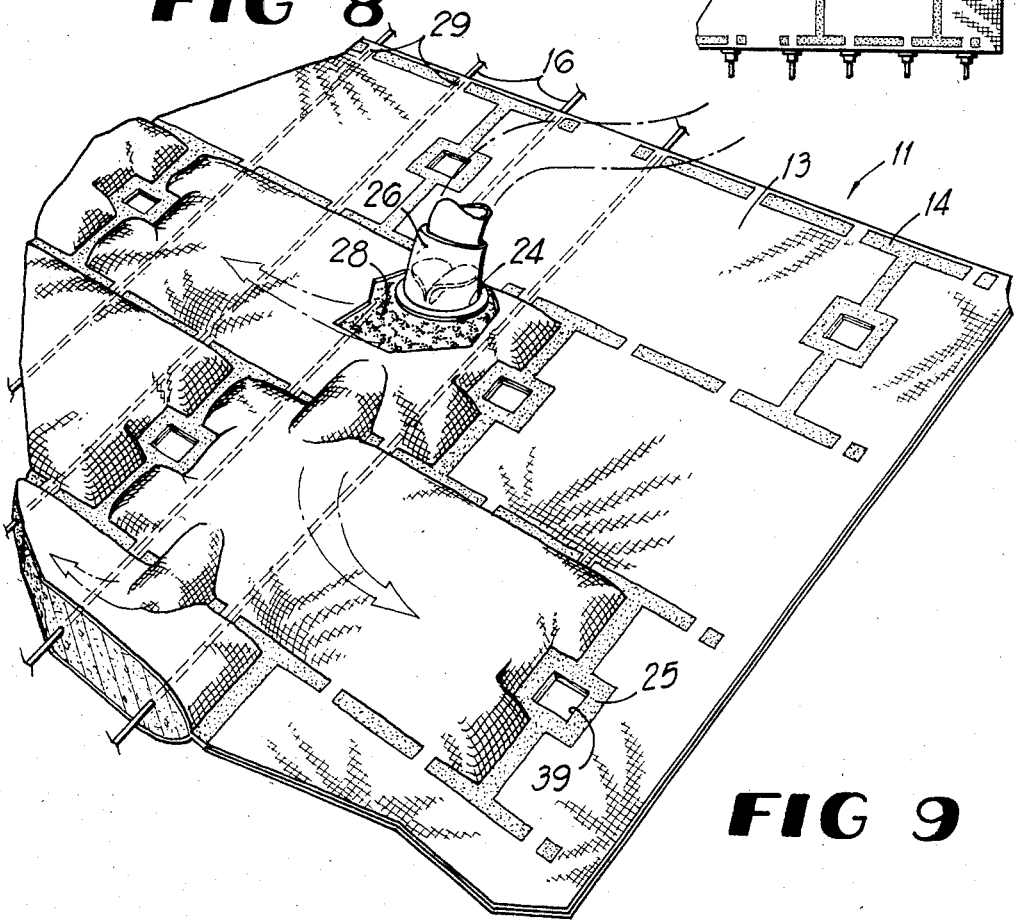
FIG. 9 is a perspective view of one embodiment of the web of the present invention.

Openings 24 may take the form of valves 26 which are placed in fabric layers 12 and shown in FIGS. 3 and 9, rather than being cuts into fabric layers 12. Such valves may be affixed at the manufacturing site or at the installation site, in a configuration suitable to the terrain features and other requirements of a particular installation. Valves 26 allow a one-way flow of filler material 28, and allow easy connecting and disconnecting of filler hose 23.

Pumping of filler material 28 into compartments 13 causes the edges of those compartments to draw inward, thereby pulling the unfilled compartments 13 of web 11 toward the filled compartments. Such shrinkage of approximately 20 percent of pre-filled dimensions of web 11 is typically encountered. Because compartments 13 in a column and not in a row communicate with one another by means of filling slots 27, accurate positioning of web 11 is thereby enhanced. A first column of compartments at one side edge of web 11 may be placed and filled in the final resting position of that column. When it is filled, the column acts as an anchor; compartments 13 in the adjacent column draw themselves toward the first anchor column as they are filled and themselves become anchors acting with compartments 13 in the first column. Thus, the columnar filling feature of the present invention allows the installer accurately to place an anchor column of compartments 13 and thereby accurately to determine the final resting position of all filled compartments 13 of revetment mat 31. Portions of cables 16 may be restrained during filling, if it is desired that cables 16 penetrate the central portion of hardened forms 30 rather than buckling.

Web 11 may be produced on a loom which is capable of weaving two sheets of fabric simultaneously, and which may be programmed or configured to interweave the two sheets of fabric where appropriate to produce a single selvage layer. In the preferred embodiment of the present invention, the loom is configured to weave web 11, shown in plan in FIG. 8, by weaving two separate sheets of fabric or fabric layers 12, which form the walls of compartments 13, and by weaving the two sheets of fabric to form selvage 14 interconnecting and separating compartments 13. Web 11 may also be produced by producing two separate sheets of fabric and fastening them together by means other than interweaving to form selvage 14, including stitching, heat bonding or stapling. Web 11 may be woven of nylon, fiberglass, natural fiber, polypropylene, or any other material having the appropriate sensitivity to ultraviolet light, flexibility, porosity, durability and cost parameters required for a given installation. The top fabric layer 12 may be of material different from that of the bottom fabric layer 12; for instance, the top layer may be a sacrificial layer and the bottom an ultraviolet-stabilized filter layer, to achieve a resulting revetment panel of hardened forms interconnected by cables or other means lying on top of a layer of filter fabric. Obviously, other combinations of fabric layers 12 may be used to achieve differing results.

Cables 16, which are placed in web 11 during manufacture or installation, are permanent in nature, and should be of sufficient strength and durability to interconnect hardened forms 30 of the present invention after fabric layers 12 have worn away. They may be aircraft cable, other metallic cable, rope, chain, fabric or polypropylene straps or of any other similar material having the requisite strength, durability and cost parameters.

Filler material 28 may be a slurry or mortar of cementitious material, or it may be simply a mixture of water and sand, water, sand and gravel or other appropriate material if integrity of the revetment panel after degredation of web 11 is not a concern. In either event, locally found sand and gravel may be used.

Figure 2:
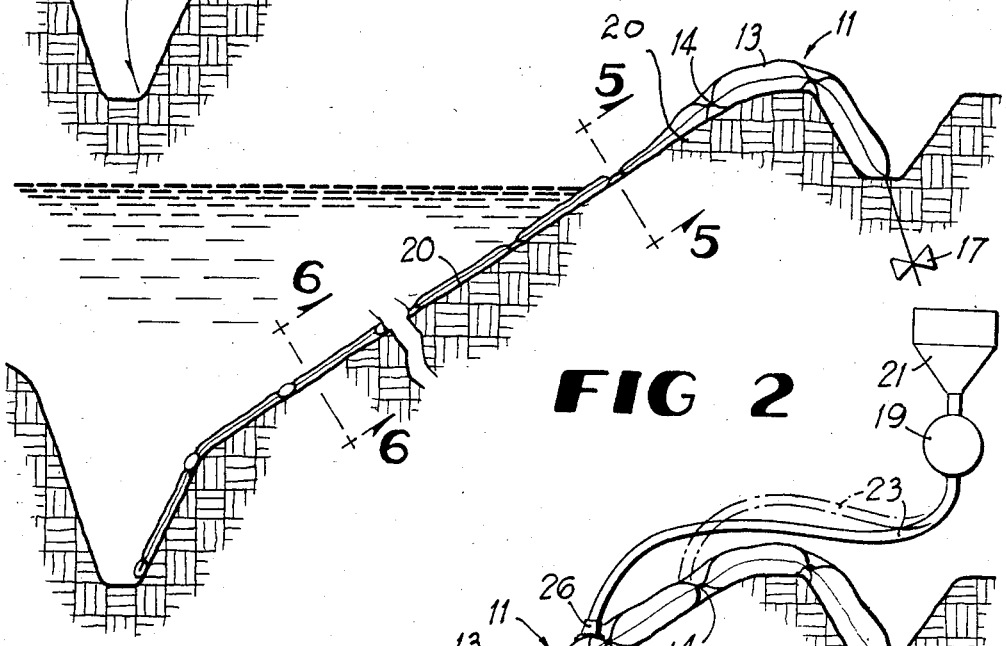
FIG. 2 is a side elevational view of the web of FIG. 1 wherein the uppermost compartments of the web have been filled with filler material.
Figure 5:
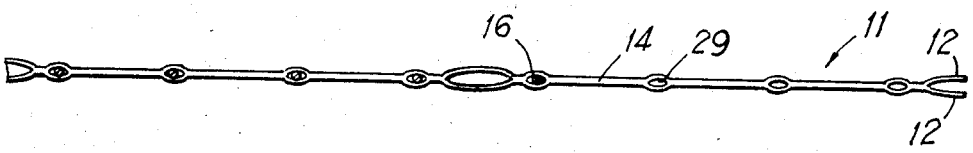
FIG. 5 is a sectional view of the web of FIG. 2 corresponding to Section 5—5 of that figure.

FIG. 5 shows a longitudinal cross-section of the lateral selvage 14 of web 11 corresponding to section 5—5 of FIG. 2. Filling slots 27 are shown, through which filler material 28 flows during the filling process. Cable slots 29 are also shown, through which cables 16 are threaded during web 11 manufacture or installation, after web 11 is woven. Cable slots 29 are sufficiently small in cross-sectional area to prevent a significant amount of filler material 28 from flowing through or being contained in them. In this fashion, cable slots 29 do not impede the flexibility of revetment mat 31 because they do not allow significant cement bonds to form between hardened forms 30.

Figure 6:
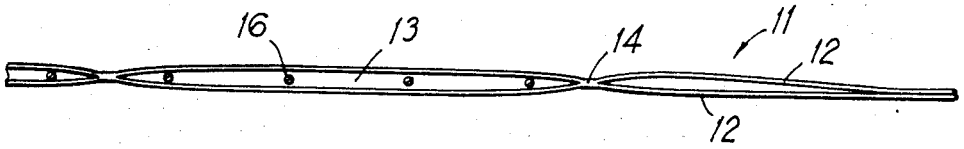
FIG. 6 is a sectional view of the web of FIG. 2 corresponding to Section 6—6 of that figure.
Figure 7:
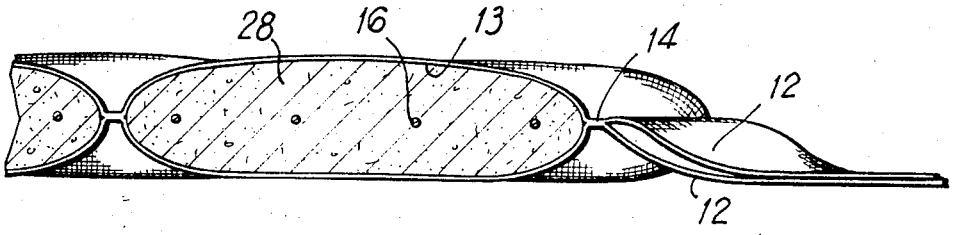
FIG. 7 is a sectional view of the web of FIG. 3, corresponding to Section 7—7 of that figure.

FIG. 6 is a longitudinal cross-section of compartments 13 of web 11 corresponding to section 6—6 of FIG. 2. The relationship of fabric layers 12 and selvage 14 can be seen in this figure. FIG. 7, a cross-sectional view corresponding to section 7—7 of FIG. 3, shows filler material 28 in compartments 13.

Figure 8:
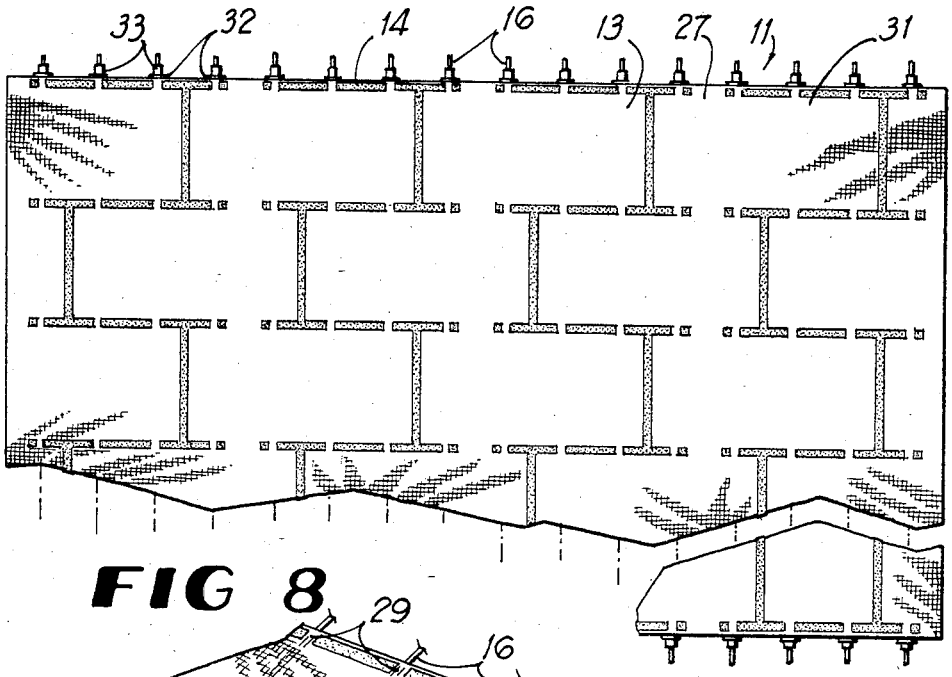
FIG. 8 is a plan view of one embodiment of the web of the present invention.

FIGS. 8 and 9 illustrate one form of placement of selvage 14 and cables 16 in web 11. Selvage 14, if permeable to water, acts as a membrane to relieve the hydraulic pressure differential above and below web 11. Selvage 14 may contain one or more notches 25, as shown in FIG. 9, to allow even more relief. It may also be serpentine, zig-zag or of other non-linear or irregular shape to interrupt and impede the flow of water in the vicinity of the selvage. Furthermore, holes 39 may be cut, burned or otherwise formed in selvage 14 to increase the permeability of web 11 to water. Filling slots 27, as well as cable slots 29 in selvage 14, can also be seen.

Cables 16 extend in a single direction through web 11 and in the present embodiment are arranged so that four cables penetrate each compartment 13 in the longitudinal direction. At the edges of web 11, washers 32 and cable stops 33 may be placed on cables 16 to hold them in place in web 11. Cable stops may be conventional swages, knots, clips, or other means for terminating cables 16.

Figure 10:
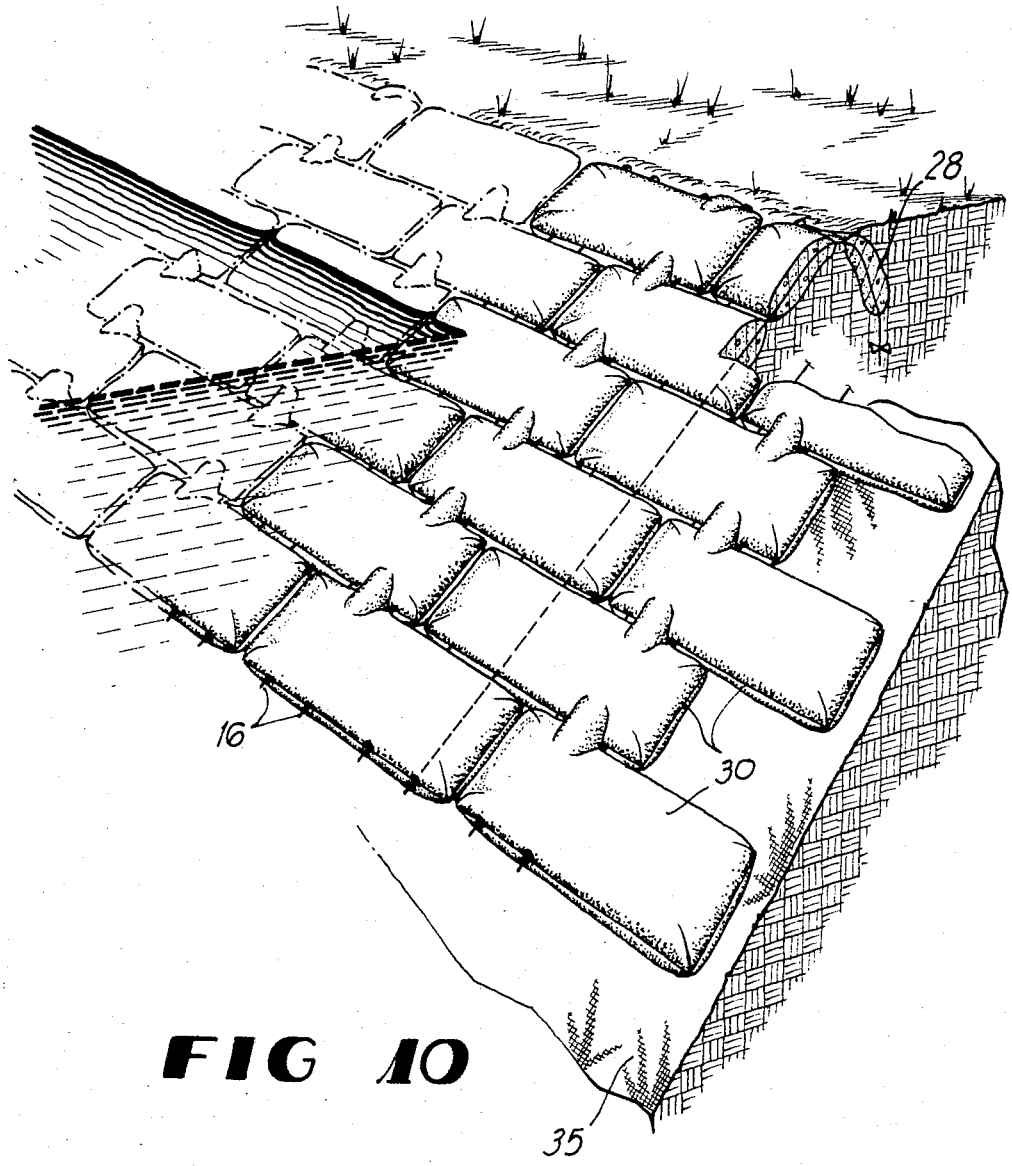
FIG. 10 is a perspective view of one embodiment of the revetment panel of the present invention in place.

Over a period of time, fabric layers 12 and selvage 14 of web 11 may wear partially or completely away leaving hardened forms 30 interconnected by cables 16 to form a revetment mat 31 as shown in FIG. 10. Because the inflated filling slots 27 are of minor cross-sectional area compared to hardened forms 30, they serve as controlled failure areas; they tend to fail or break and in so doing, leave a highly articulable revetment mat 31. This mat 31 of interconnected forms becomes even more articulable if one or both fabric layers 12 wear away.

Web 11 may be installed on top of a sheet or sheets of filter fabric 35 to achieve further protection of surface 20. Such an installation may be appropriate where both fabric layers 12 are impermanent in nature, and revetment mat 31 would otherwise be without filtering means after fabric layers 12 have worn away.

The foregoing description of the present invention is for purposes of explanation and illustration. It will be apparent to those skilled in the relevant art that modifications and changes made be made to the invention as described without departing from the scope and spirit thereof.

We claim:

1. A web comprising:

(a) an upper and a lower fabric layer;

(b) compartments which are staggered in relation to one another, having walls formed by the fabric layers;

(c) selvage separating the compartments, formed by fastening together the fabric layers;

(d) a plurality of cable slots formed in the selvage, each communicating with at least one of the compartments;

(e) a plurality of longitudinal cables, each passing through at least one cable slot and interconnecting at least two compartments; and (f) a plurality of filling slots formed in the selvage, each communicating with at least one of the compartments.

2. The web according to claim 1 further comprising at least one opening in one of said walls of at least one of said compartments communicating between the exterior and interior of the compartments.

3. The web according to claim 2 further comprising at least one washer and at least one cable stop on at least one of said cables.

4. A web comprising:

(a) an upper and a lower fabric layer;

(b) a plurality of compartments which are staggered in relation to one another having walls formed by weaving separately the fabric layers;

(c) lateral and longitudinal selvage separating the compartments, formed by interweaving the fabric layers;

(d) a plurality of cable slots formed in the lateral selvage by weaving separately the fabric layers, each of the cable slots communicating with at least one of the compartments;

(e) a plurality of longitudinal cables, each passing through at least one cable slot and interconnecting at least two compartments;

(f) a plurality of filling slots formed in the lateral selvage by weaving separately the fabric layers, each of the filling slots communicating with at least one of the compartments;

(g) at least one opening in one of the walls of at least one of the compartments communicating between the exterior and interior of the compartments; and (h) at least one washer and at least one cable stop on at least one of the cables.

5. The web according to claim 4 wherein said upper fabric layer is made of material different from that of which said lower fabric is made.

6. A revetment panel comprising:

(1) A web comprising:

(a) an upper and a lower fabric layer;

(b) a plurality of compartments which are staggered in relation to one another, having walls formed by the fabric layers;

(c) selvage separating the compartments, formed by fastening together the fabric layers;

(d) a plurality of cable slots formed in the selvage, each communicating with at least one of the compartments;

(e) a plurality of longitudinal cables, each passing through at least one cable slot and interconnecting at least two compartments; and (f) a plurality of filling slots formed in the selvage, each communicating with at least one of the compartments; and (2) filler material occupying the interior of the compartments of the web.

7. A revetment panel comprising:

(1) a web comprising:

(a) an upper and a lower fabric layer;

(b) a plurality of compartments which are staggered in relation to one another having walls formed by weaving separately the fabric layers;

(c) lateral and longitudinal selvage separating the compartments, formed by interweaving the fabric layers;

(d) a plurality of cable slots formed in the lateral selvage by weaving separately the fabric layers, each of the cable slots communicating with at least one of the compartments;

(e) a plurality of longitudinal cables, each passing through at least one cable slot and interconnecting at least two compartments;

(f) a plurality of filling slots formed in the lateral selvage by weaving separately the fabric layers, each of the filling slots communicating with at least one of the compartments;

(g) at least one opening in one of the walls of at least one of the compartments communicating between the exterior and interior of the compartments; and (h) at least one washer and at least one cable stop on at least one of the cables; and (2) filler material occupying the interior of the compartments of the web.

8. A method of producing a web comprising the steps of weaving two fabric layers, fastening together the fabric layers to form lateral and longitudinal selvage separating a plurality of rows and columns of compartments, which rows of compartments are staggered in relation to one another, and forming a plurality of cable slots and filling slots in the lateral selvage, each of the slots communicating with at least one of the compartments.

9. The method according to claim 8 wherein said step of fastening together the fabric layers comprises interweaving the fabric layers to form lateral and longitudinal selvage separating the compartments, and said step of forming a plurality of cable slots and filling slots in the lateral selvage comprises weaving separately the fabric layers to form the slots.

10. The method according to claim 8 further comprising the step of inserting, for each column of compartments, at least one cable through at least one of said cable slots in such a manner that at least two of the compartments are longitudinally connected by the cables.

11. The method according to claim 9 further comprising the step of placing an opening in at least one of said walls of at least one of said compartments, the opening communicating between the exterior and interior of the compartments.

12. The method according to claim 8 wherein said step of weaving, with two fabric layers, a web employs a first fabric layer made of material different from that of the second fabric layer.

13. A method of producing a revetment panel comprising the step of filling with filler material the compartments of the web recited in claim 1.

14. A method of producing a revetment panel comprising the step of filling with filler material the compartments of the web recited in claim 4.

15. A method of producing a revetment panel comprising the steps of:

(a) weaving two fabric layers separately to form a plurality of rows and columns of compartments, which rows of compartments are staggered in relation to one another; interweaving the fabric layers to form lateral and longitudinal selvage separating the compartments; and weaving the fabric layers separately to form a plurality of cable slots and filling slots in the lateral selvage, each of the slots communicating with one or more of the compartments;

(b) inserting, for each column of compartments, at least one cable through at least one of the cable slots in such a manner that at least two of the compartments are longitudinally interconnected by the cables; and (c) filling with filler material at least one of the compartments of the web.

16. The method according to claim 15 further comprising the step of placing an opening in at least one of said walls of at least one of said compartments communicating between the exterior and interior of the compartments.

17. The method according to claim 16 wherein the step of placing an opening in at least one of said walls of at least one of said compartments comprises the step of placing a valve in the wall, and said step of filling the compartments with said filler material further comprises the steps of:

(a) attaching one end of a filler hose to at least one of the valves;

(b) pumping the filler material through the valve to a predetermined pressure;

(c) disconnecting the end of the filler hose from the valve; and (d) repeating steps (a) through (c) until a predetermined number of the compartments of the web are inflated with the filler material.

18. The method according to claim 16 wherein the step of filling said compartments with said filler material further comprises the steps of:

(a) passing one end of a filler hose through one of said openings;

(b) pumping the filler material through the opening to a predetermined pressure;

(c) withdrawing the filler hose from the opening;

(d) sealing the opening; and (e) repeating steps (a) through (d) until a predetermined number of compartments of the web are inflated with the filler material.

19. The method according to claim 16 further comprising the step of joining together adjacent webs.

* * * * *